US006457197B1

(12) United States Patent
Wu

(10) Patent No.: US 6,457,197 B1
(45) Date of Patent: Oct. 1, 2002

(54) SWIFT CONNECTION JOINT BETWEEN AIRBAGS

(76) Inventor: Shang-Neng Wu, No 81 Rong-Xing Street, Ping-Zhen City, Tao Yuan (TW)

( * ) Notice: Subject to any disclaimer, the term of this patent is extended or adjusted under 35 U.S.C. 154(b) by 0 days.

(21) Appl. No.: 09/717,467

(22) Filed: Nov. 20, 2000

(51) Int. Cl.[7] ..... A47C 27/10
(52) U.S. Cl. ..... 5/655.3; 5/710
(58) Field of Search ..... 5/655.3, 710, 644, 5/654, 706, 713

(56) References Cited

U.S. PATENT DOCUMENTS 1,198,687 A * 9/1916 Williams et al. ..... 5/655.3
2,655,369 A * 10/1953 Musilli ..... 5/710 X

* cited by examiner

*Primary Examiner*—Robert G. Santos
(74) *Attorney, Agent, or Firm*—Pro-Techtor International Services

(57) ABSTRACT

The present invention relates to a Swift Connection Joint Between Airbags. This invention includes a device named swift connection joint, instead of the air-pipes that are used in conventional air mattresses. The swift connection joint consists of first main unit and second main unit to be adhered to two airbags, respectively, as well as a locking part for installation of both main units. With the above-mentioned components, the swift connection joint can be assembled/disassembled easily, and does not fall apart. Therefore, the present invention is an ideal device for transmission of air into air mattress.

2 Claims, 7 Drawing Sheets

SWIFT CONNECTION JOINT BETWEEN AIRBAGS

BACKGROUND OF THE INVENTION

1. Field of the Invention

The present invention relates to a swift connection joint between airbags that substitutes for the conventional air-pipes. The present invention is easy to assemble/disassemble, and doesn't require much space as opposed to the conventional air-pipes. Most importantly, the present invention doesn't fall apart once it is locked on the airbags; whereas the conventional air-pipes fall apart and air leaks easily. In addition, the present invention has a pleasant appearance once it is installed, and is, therefore, a better device.

2. Description of the Prior Art

The present invention is named Swift Connection Joint Between Airbags, referring to a device connecting airbags that allows swift transmission of air into the airbags.

SUMMARY OF THE INVENTION

There are a number of medical-purposed air mattresses in the market designed to help bed-ridden patients prevent decubitus from happening. The air mattresses consist of strips of airbags that are aligned parallelly. All airbags are filled up with air. Air is injected into the airbags via the air-pipes between airbags. Air-pipes are installed between airbags, so air can be transmitted into airbags. It is difficult to assemble the airbags and air-pipes together perfectly. Manufacturers usually install several air-pipes and multi-openings pipes in the airbags in advance. Although user can inject air into the mattress via the pipes, the connection between airbags and air-pipes is extremely complicated for users. To a worse extent, the complicated installation method does not fix the pipes in the mattress tightly. Therefore, the pipes fall apart easily. The complicated installation also makes the mattress look ugly. When distributors ship the mattresses to users, the mattresses are folded in boxes. The air-pipes can be damaged or fall apart in the shipment easily. These are common problems associated with the conventional air mattress for which consumers complain frequently.

The primary object of the present invention is to improve the air-intake problem of conventional air mattress, and to upgrade the performance of airbags, thereby makes the air mattress work better for user's convenience.

The present invention will be apparent in its contents of technique after reading the detailed description of the preferred embodiments of the present invention in reference to the accompanying drawings, wherein:

DETAILED DESCRIPTION OF THE PREFERRED EMBODIMENT

Figure 1:
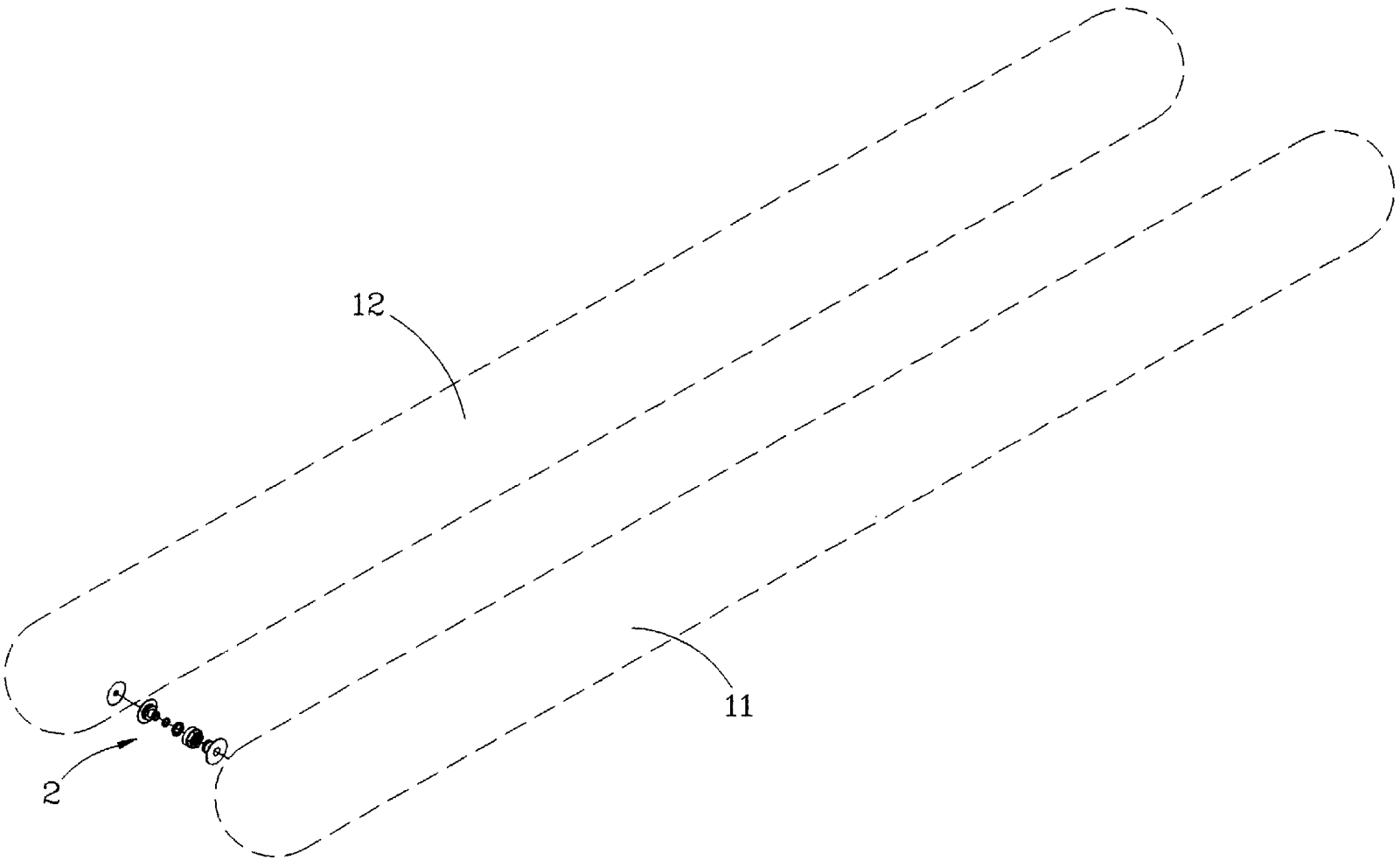
FIG. 1 is a three-dimensional perspective view of present invention.
Figure 2:
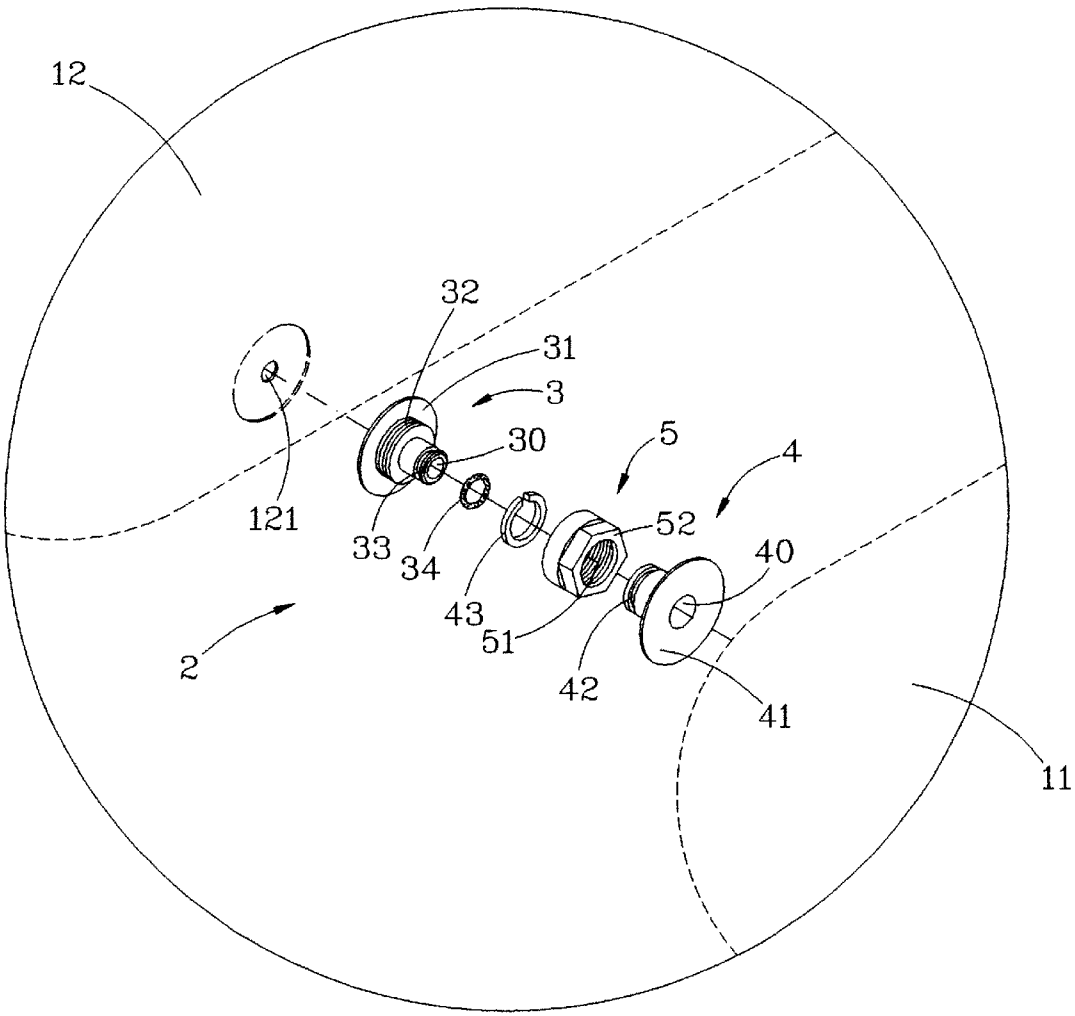
FIG. 2 is a partial perspective view of present invention.
Figure 3:
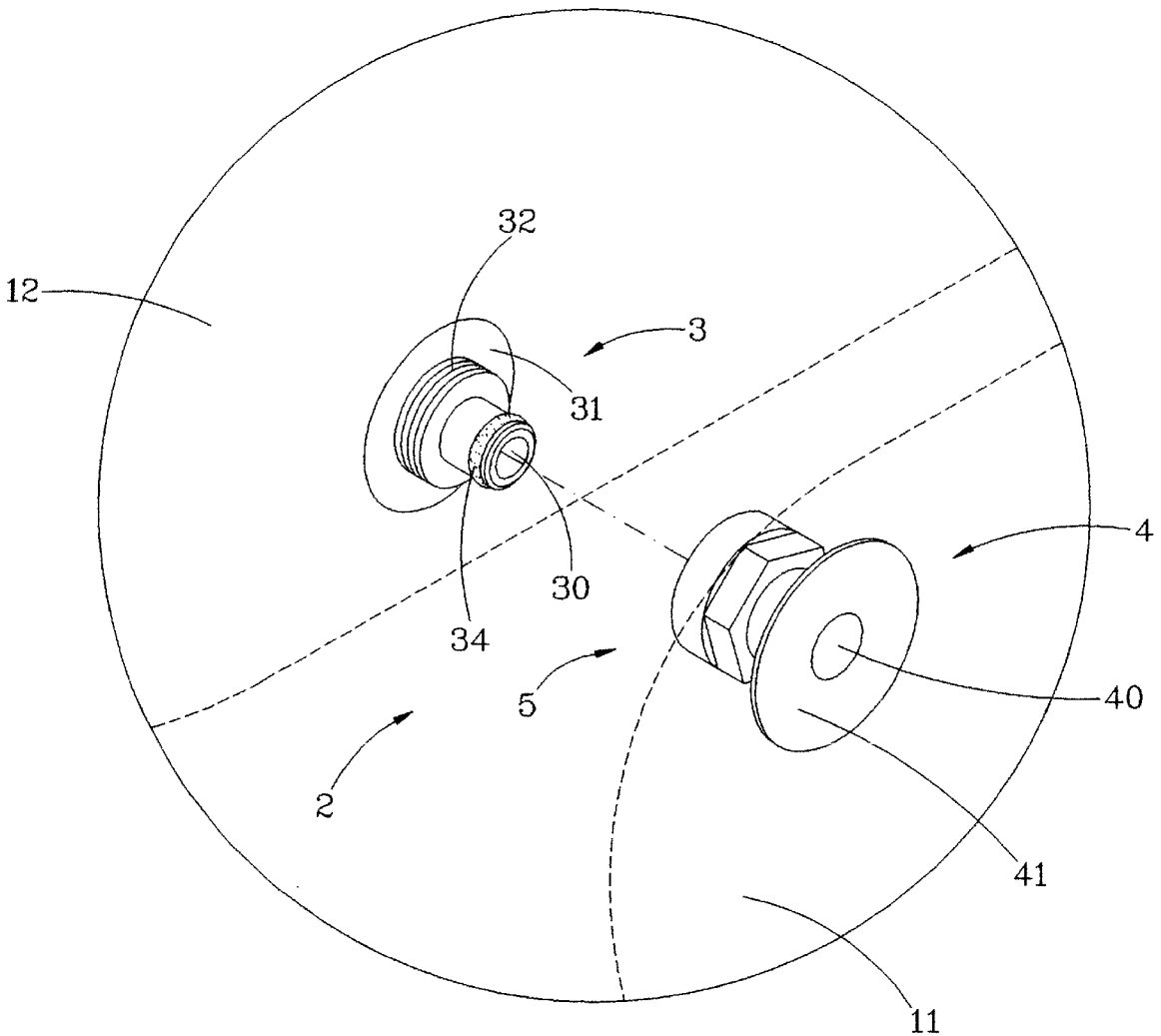
FIG. 3 is a partial three-dimensional assembly drawing of present invention.

Please refer to the drawings and following example for the structure of present invention Swift Connection Joint Between Airbags, and how the present invention works:

As shown by FIG. 1, FIG. 2, and FIG. 3, the swift connection joint of present invention 2 consists of first main unit 3, second main unit 4, and locking part 5. In this example:

There is a hole 30 in the center of first main unit 3. On the bottom of hole 30 is a connection ring 31. The connection ring 31 is adhered to the ring on the opening 121 of airbag 12 with glue. That's how the hole 30 and opening 121 are connected. There is a screw 32 on the first main unit 3, and an oil-sealing 34 on the concave ring 33.

There is a hole 40 on the center of second main unit 4. On the bottom of hole 40 is a connection ring 41. The connection ring 41 is adhered to the airbag 11 with glue. That' show the hole 40 and airbag 12 are connected internally. There is a concave ring 42 on the second main unit 4. A C-shaped buckle 43 covers the concave ring 42.

The locking part 5 resembles a cap with screw 51 inside. The screw 51 locks the screw 32 of first main unit 3. Please note the blocking ring 52 on the bottom of locking part 5.

Figure 4:
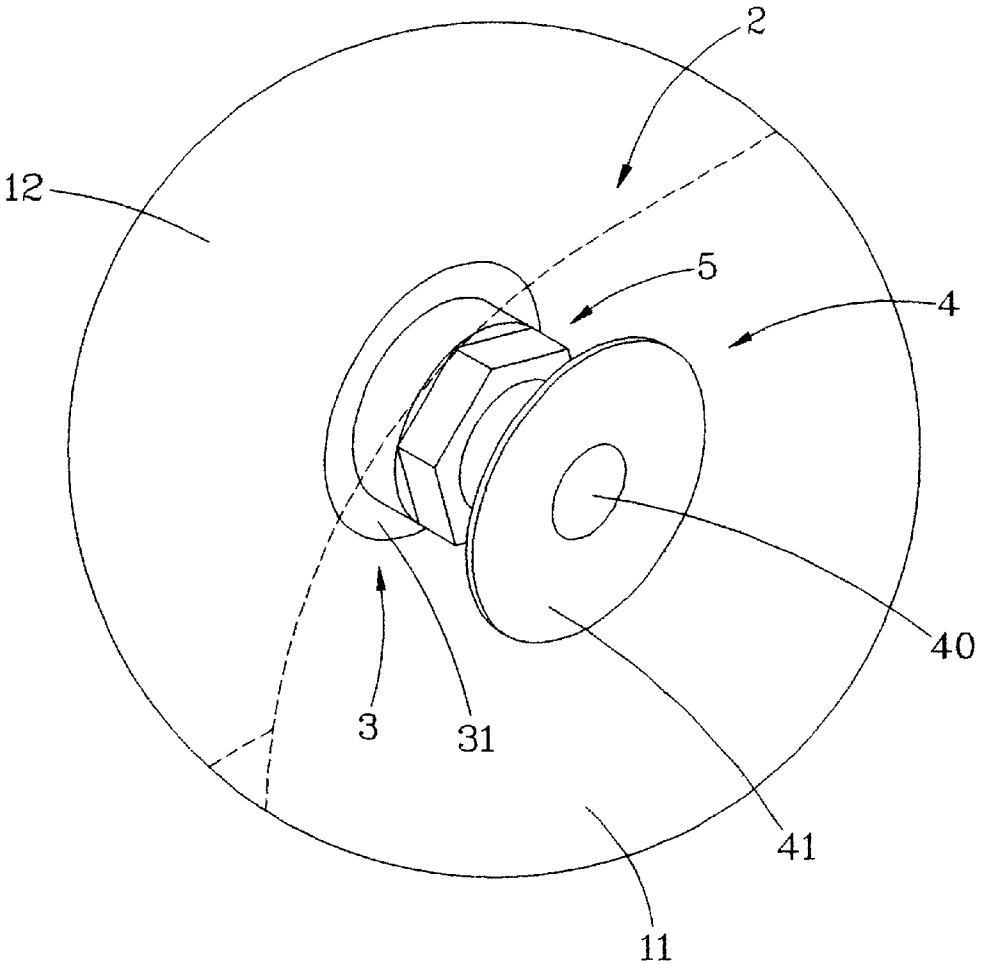
FIG. 4 is a three-dimensional assembly drawing of present invention.
Figure 5:
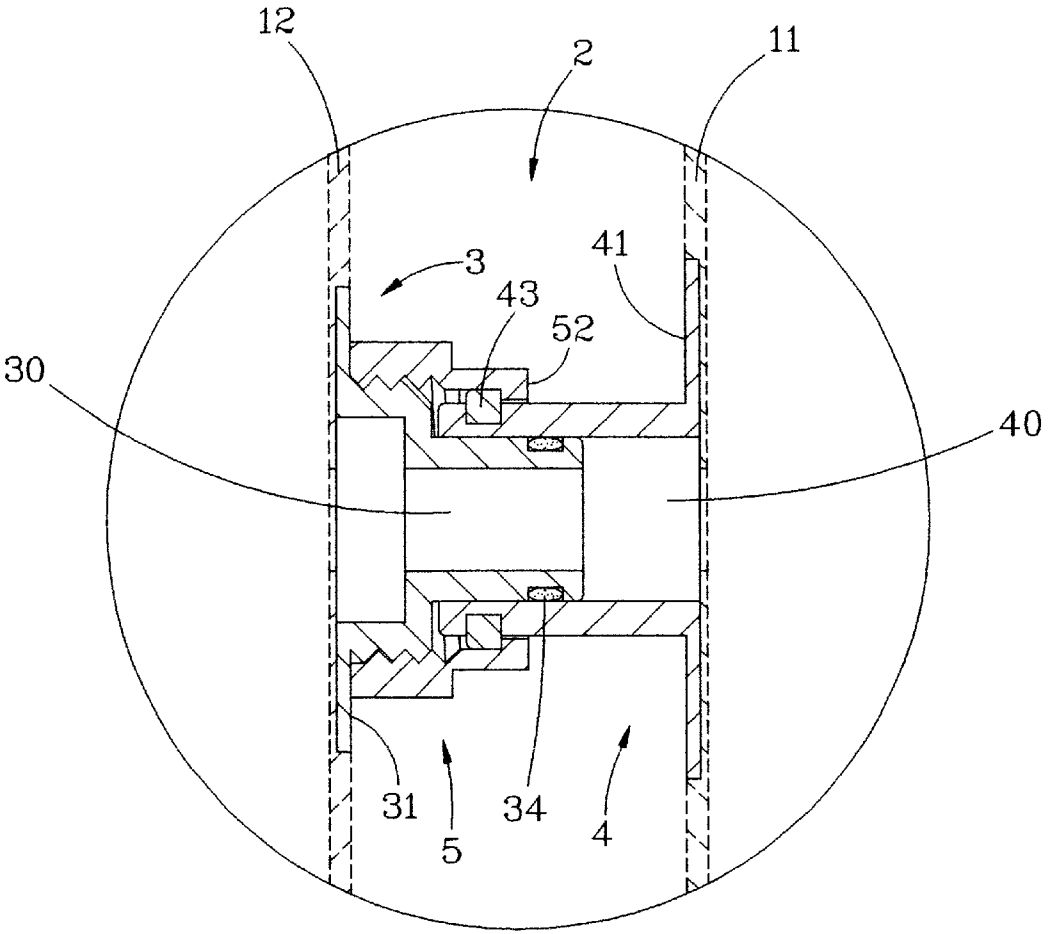
FIG. 5 is a sectional assembly drawing of present invention.

As we understand the functions of above-mentioned components, now we adhere first main unit 3 and second main unit 4 on airbags 12 and 11 by glue, respectively, and cover the locking part 5 on second main unit 4, and then cover the C-shaped buckle 43 on the concave ring 42, thereby fix the locking part 5 of second main unit 4 (as shown by FIG. 3). Later on, we can complete the installation of swift connection joint 2 by locking the screw 51 of locking part 5 and the screw 32 of first main unit 3 together. Then the device is ready to transmit air to the airbags 11, 12 (as shown by FIG. 4 and FIG. 5).

Whenever either airbag 11, 12 is broken, we can twist the locking art 5 to disassemble the swift connection joint 2 for replacement of new airbag. The process of replacement is easy and convenient.

The size of swift connection joint 2 of present invention is rather small. As such, the present invention has a pleasant appearance once it is installed on air mattress.

Figure 6:
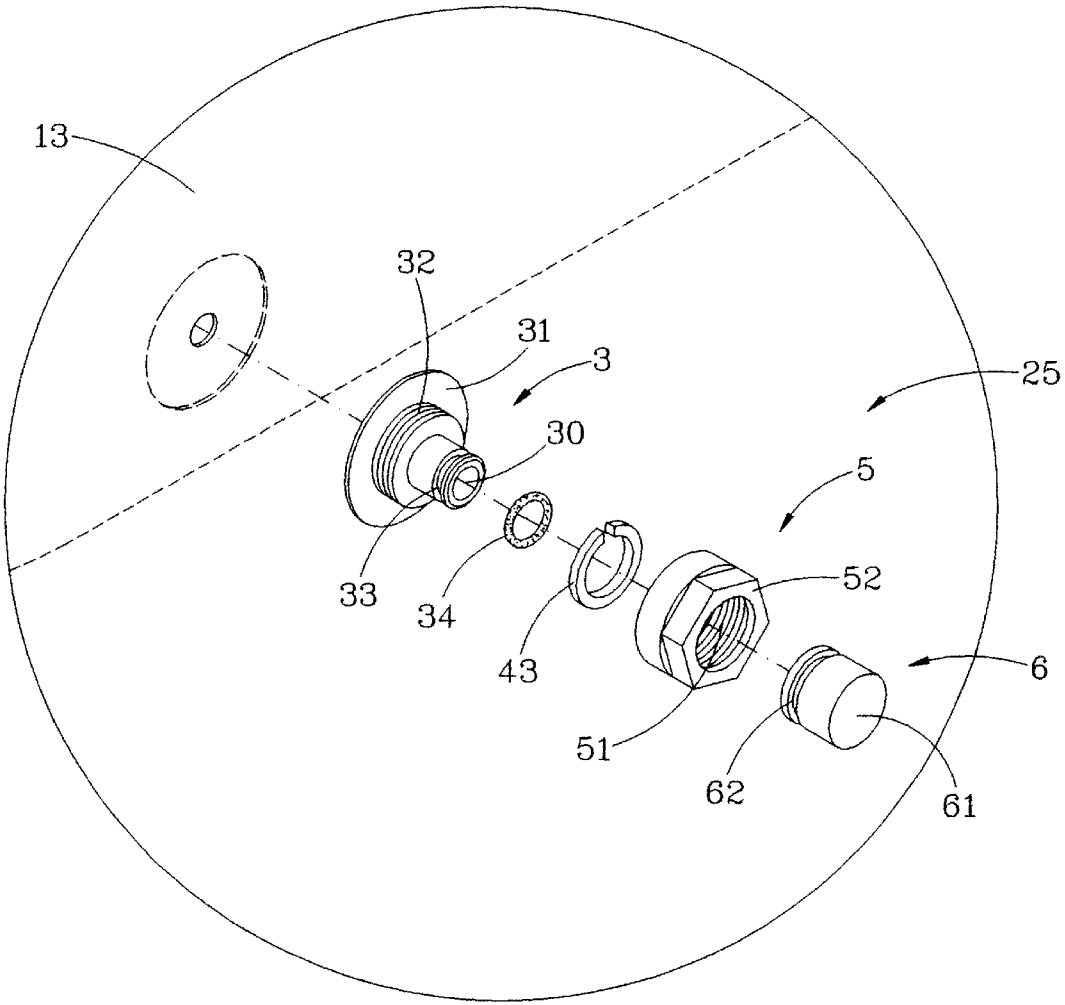
FIG. 6 shows the application of present invention.

As shown by FIG. 6, when the swift connection joint 25 of present invention is installed on the most-outside airbag 13, third main unit 6 shall substitute for the second main unit 4. The third main unit 6 is slightly cylinder-shaped with a closing-end on one side. There is a concave ring 62. A C-shaped buckle 43 covers the concave ring 62. User may lock the locking part 5 of first main unit 3 to close the swift connection joint 25.

Figure 7:
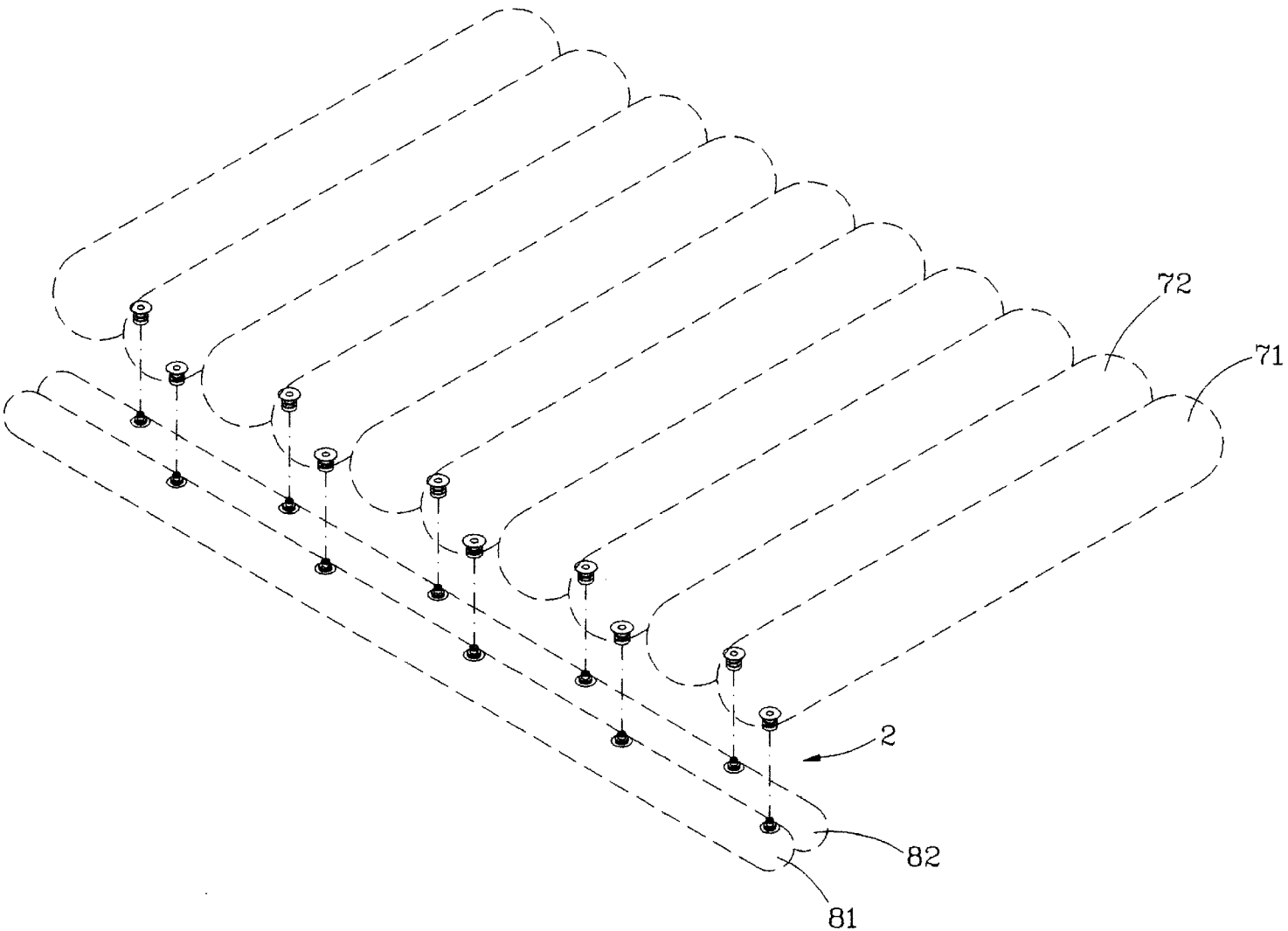
FIG. 7 shows another application of present invention.

FIG. 7 is another example of application of present invention. The air mattress consists of air-pipes 81, 82 and airbags 71, 72. The air-pipes 81, 82 transmit air to airbags 71, 72 by the swift connection joint 2 of present invention.

As shown by previous description and examples, the Swift Connection Joint Between Airbags of present invention is a product of breakthrough. Its unique features are practical and useful, and have never been publicized in any documentation, nor brought to the market before. These features meet the requirements of innovation, practicability, and progress fully. The present invention is, therefore, industrially valuable.

Having thus described the invention, what the inventor claims as new and desire to be secured by Letters Patent of the United States include:

1. A swift connection joint between airbags comprising:

a first main unit, a second main unit, and a locking part; wherein said first main unit comprises a through hole, and a connection ring on a base end of said first main unit, said connection ring being secured to an opening of a first airbag, said first main unit further comprises a threaded area, and a gasket affixed to a nipple portion of said first main unit, said second main unit comprises a through hole aligned with said through hole of said first main unit, and a connection ring on a base end of said second main unit, said connection ring being secured to an opening of a second airbag, and a lock washer mounted on a nipple portion of said second main unit, and said locking part contains a threaded interior portion, said locking part mates with said threaded area of said first main unit, said nipple portion of said first main unit being received in said nipple portion of said second main unit, thereby securing said first main unit and said second main unit between said first and said second airbags.

2. The swift connection joint between airbags as defined in claim 1 wherein:

a sealing cap is inserted into said locking part to seal said first airbag, said first main unit being separated from said second main unit.

* * * * *